US010744374B1

(12) United States Patent
DiLorenzo et al.

(10) Patent No.: US 10,744,374 B1
(45) Date of Patent: Aug. 18, 2020

(54) SWIM FIN WITH AN UPPER PORTION HAVING DEBOSSED REGIONS AND TRIPLE-BLADED RAILS

(71) Applicant: TYR Sport, Inc., Farmingdale, NY (US)

(72) Inventors: Matthew Vito DiLorenzo, New York, NY (US); Wei-Chieh Tu, Forest Hills, NY (US)

(73) Assignee: TYR SPORT, INC., Farmingdale, NY (US)

( * ) Notice: Subject to any disclaimer, the term of this patent is extended or adjusted under 35 U.S.C. 154(b) by 0 days.

(21) Appl. No.: 16/377,546

(22) Filed: Apr. 8, 2019

(51) Int. Cl.
*A63B 31/11* (2006.01)

(52) U.S. Cl.
CPC ..... *A63B 31/11* (2013.01)

(58) Field of Classification Search
CPC ..... A63B 31/00; A63B 31/06; A63B 31/08; A63B 31/11
USPC ..... 441/61, 62, 64
See application file for complete search history.

(56) References Cited

U.S. PATENT DOCUMENTS

| | | | |
|---|---|---|---|
| 2,099,973 | A | 11/1937 | De Corlieu |
| 2,321,009 | A | 6/1943 | Churchill |
| 2,343,468 | A | 3/1944 | Messinger |
| 2,737,668 | A | 3/1956 | Cressi et al. |
| 2,779,077 | A | 1/1957 | Kline |
| 2,889,563 | A | 6/1959 | Lamb et al. |
| 3,082,442 | A | 3/1963 | Costeau et al. |
| 3,178,738 | A | 4/1965 | La Trell |
| 3,411,165 | A | 11/1968 | Murdoch |
| 3,810,269 | A | 5/1974 | Tabata et al. |
| 4,300,255 | A | 11/1981 | Beuchat |
| 4,521,220 | A | 6/1985 | Schoops |

(Continued)

FOREIGN PATENT DOCUMENTS

| | | |
|---|---|---|
| EP | 0308998 | 3/1989 |
| EP | 0436927 | 7/1991 |

(Continued)

OTHER PUBLICATIONS www.amazon.com, "Oceanic V-Flex Snorkling Fins", Jan. 11, 2012, 6 pages.

(Continued)

*Primary Examiner* — Lars A Olson
(74) *Attorney, Agent, or Firm* — Stetina Brunda Garred and Brucker

(57) ABSTRACT

A swim fin includes a foot pocket with a front and rear sections and an upper portion. The upper portion has a dorsal region, and first and second debossed regions with the dorsal region disposed between the debossed regions. The first and second debossed regions are laterally positionable adjacent the metatarsophalangeal joints of the foot of the user. The debossed region includes grooves formed therein. The foot pocket includes a foot pocket cavity. The swim fin further includes a fin blade extending from the front section of the foot pocket. The fin blade has a distal edge, a blade body disposed between the distal edge and the front section, and first and second triple-bladed rails. The triple-bladed rails are disposed longitudinally along the foot pocket and the blade body with the foot pocket and the blade body disposed between the first and second triple-bladed rails.

11 Claims, 3 Drawing Sheets

(56) References Cited

U.S. PATENT DOCUMENTS

| | | | | |
|---|---|---|---|---|
| 4,689,029 | A | 8/1987 | Ciccotelli | |
| 4,737,127 | A | 4/1988 | Lamont | |
| 4,795,384 | A | 1/1989 | Hattori | |
| 4,795,385 | A | 1/1989 | Matsuoka | |
| 4,838,824 | A | 6/1989 | McCredie | |
| 4,887,985 | A | 12/1989 | Garofalo | |
| 4,948,385 | A | 8/1990 | Hall | |
| D313,640 | S | 1/1991 | Fujiwara | |
| 5,083,954 | A | 1/1992 | Jacobs | |
| 5,108,328 | A | 4/1992 | Hull | |
| 5,163,859 | A | 11/1992 | Beltrani et al. | |
| 5,304,081 | A | 4/1994 | Takizawa | |
| 5,358,439 | A | 10/1994 | Paolo | |
| 5,387,145 | A | 2/1995 | Wagner | |
| D357,965 | S | 5/1995 | Maggi | |
| 5,435,764 | A | 7/1995 | Testa et al. | |
| 5,443,593 | A | 8/1995 | Garofalo | |
| 5,545,067 | A | 8/1996 | Garofalo | |
| 5,702,277 | A | 12/1997 | Wagner | |
| 5,746,631 | A | 5/1998 | McCarthy | |
| 5,810,629 | A | 9/1998 | Parr | |
| 6,050,868 | A | 4/2000 | McCarthy | |
| 6,095,879 | A | 8/2000 | McCarthy | |
| 6,109,990 | A * | 8/2000 | Lundberg | A63B 21/0084 441/64 |
| 6,126,503 | A | 10/2000 | Viale et al. | |
| 6,146,224 | A | 11/2000 | McCarthy | |
| 6,183,327 | B1 | 2/2001 | Meyer | |
| 6,227,924 | B1 | 5/2001 | Miller | |
| 6,290,561 | B1 | 9/2001 | Garofalo et al. | |
| 6,341,383 | B1 | 1/2002 | Beltrani | |
| 6,364,728 | B1 | 4/2002 | Viale et al. | |
| 6,371,821 | B1 | 4/2002 | McCarthy | |
| 6,398,604 | B1 | 6/2002 | Kawashima et al. | |
| 6,461,209 | B2 | 10/2002 | Evans | |
| 6,520,816 | B1 | 2/2003 | Hu | |
| 6,568,974 | B2 | 5/2003 | Semeia | |
| 6,620,008 | B2 * | 9/2003 | Green | A63B 31/11 441/64 |
| D484,214 | S | 12/2003 | Angelini | |
| 6,758,708 | B2 | 7/2004 | Angelini | |
| 6,884,134 | B2 | 4/2005 | McCarthy | |
| 7,124,476 | B2 | 10/2006 | Garofalo et al. | |
| 7,172,480 | B2 | 2/2007 | Abbott | |
| 7,614,928 | B2 * | 11/2009 | Grivna | A63B 31/11 441/64 |
| 7,815,477 | B2 | 10/2010 | Garofalo | |
| 7,901,260 | B2 | 3/2011 | Godoy | |
| 8,251,764 | B2 | 8/2012 | Hsu | |
| 8,257,124 | B2 | 9/2012 | Garofalo et al. | |
| 9,643,055 | B2 | 5/2017 | Peloquin et al. | |
| 2005/0176317 | A1 | 8/2005 | Hseih | |
| 2006/0025027 | A1 | 2/2006 | Chen | |
| 2009/0176421 | A1 | 7/2009 | Marote | |
| 2010/0029153 | A1 | 2/2010 | Testa | |
| 2015/0335955 | A1 | 11/2015 | Shieu | |

FOREIGN PATENT DOCUMENTS

| | | |
|---|---|---|
| EP | 0579046 | 1/1994 |
| EP | 0607568 | 7/1994 |

OTHER PUBLICATIONS www.amazon.com, "Promate Junior Snorkeling Scuba Diving Mask Dry Snorkel Fins Set", Feb. 5, 2012, 6 pages.

* cited by examiner

SWIM FIN WITH AN UPPER PORTION HAVING DEBOSSED REGIONS AND TRIPLE-BLADED RAILS

CROSS-REFERENCE TO RELATED APPLICATIONS

Not Applicable.

STATEMENT RE: FEDERALLY SPONSORED RESEARCH/DEVELOPMENT

Not Applicable

BACKGROUND

1. Technical Field

The present disclosure relates generally to swim fins, and more particularly, the present disclosure relates to a swim fin having debossed regions and triple-bladed rails.

2. Related Art

Swim fins are used for a wide variety of recreational, professional, and emergency usages. Basic components include some form of foot pocket with a fin blade for propulsion. Training swim fins are specifically designed to have increased water resistance when used by the user in comparison to typical swim fins for swimming and diving. These training swim fins are used by competitive swimmers for building strength and endurance. Because of such increased water resistance, the user's foot experiences increased pressure from the foot pocket, and specific pressure points or "hot spots" may become particularly uncomfortable. As advances in technology evolve, there are opportunities for advancement in the art with respect to ease of use, comfort, and functionality of swim fins.

In view of the foregoing, there is a need in the art for an improved swim fin.

BRIEF SUMMARY

In accordance with one embodiment, there is provided a swim fin for wearing upon a foot of a user. The swim fin includes a foot pocket sized and configured to receive the foot of the user. The foot pocket includes a front section and a rear section. The foot pocket further includes an upper portion formed of an elastomeric/thermoplastic polymer material. The upper portion has a dorsal region, and first and second debossed regions with the dorsal region disposed between the first and second debossed regions. Each of the first and second debossed regions are laterally positionable adjacent the metatarsophalangeal joints of the foot of the user. Each of the first and second debossed regions has a plurality of grooves formed therein. The foot pocket further includes a sole. The foot pocket further includes a foot pocket cavity disposed between and defined by the upper portion and the sole for receiving the foot of the user. The swim fin further includes a fin blade extending from the front section of the foot pocket. The fin blade has a distal edge, a blade body disposed between the distal edge and the front section, and first and second triple-bladed rails. The first and second triple-bladed rails are disposed longitudinally along the foot pocket and the blade body with the foot pocket and the blade body disposed between the first and second triple-bladed rails. Each of the first and second triple-bladed rails has a top blade, a bottom blade, and a middle blade disposed between the top and bottom blades.

According to various embodiments, due to their decreased cross-sectional thickness, each of the first and second debossed regions may have a stiffness less than a stiffness of the dorsal region. Each of the first and second debossed regions may further have a plurality of ridges respectively disposed between the plurality of grooves. The first and second debossed regions may each have a thickness at the ridges the same as the thickness of the dorsal region. The upper portion may be formed of a thermoplastic material. The plurality of grooves of the first debossed region may generally extend towards the plurality of grooves of the second debossed region and away from the rear section, and the plurality of grooves of the second debossed region generally extend towards the plurality of grooves of the first debossed region and away from the rear section. The upper portion may have an outer surface and an opposing inner surface adjacent the foot pocket cavity, the plurality of grooves are formed in the outer surface of the upper portion. The first debossed region may have an area different than an area of the second debossed region. Each of the first and second triple-bladed rails may have a top channel disposed between the top blade and the middle blade, and a bottom channel disposed between the middle blade and the bottom blade. Each middle blade may have a thickness less than a thickness of the adjacent top and bottom blades. Each middle blade may have a lateral length less than a lateral length of the adjacent top and bottom blades.

The present invention will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which.

Common reference numerals are used throughout the drawings and the detailed description to indicate the same elements.

DETAILED DESCRIPTION

The detailed description set forth below in connection with the appended drawings is intended as a description of certain embodiments of the present disclosure, and is not intended to represent the only forms that may be developed or utilized. The description sets forth the various functions in connection with the illustrated embodiments, but it is to be understood, however, that the same or equivalent functions may be accomplished by different embodiments that are also intended to be encompassed within the scope of the present disclosure. It is further understood that the use of relational terms such as top and bottom, first and second, and the like are used solely to distinguish one entity from another without necessarily requiring or implying any actual such relationship or order between such entities.

Figure 1:
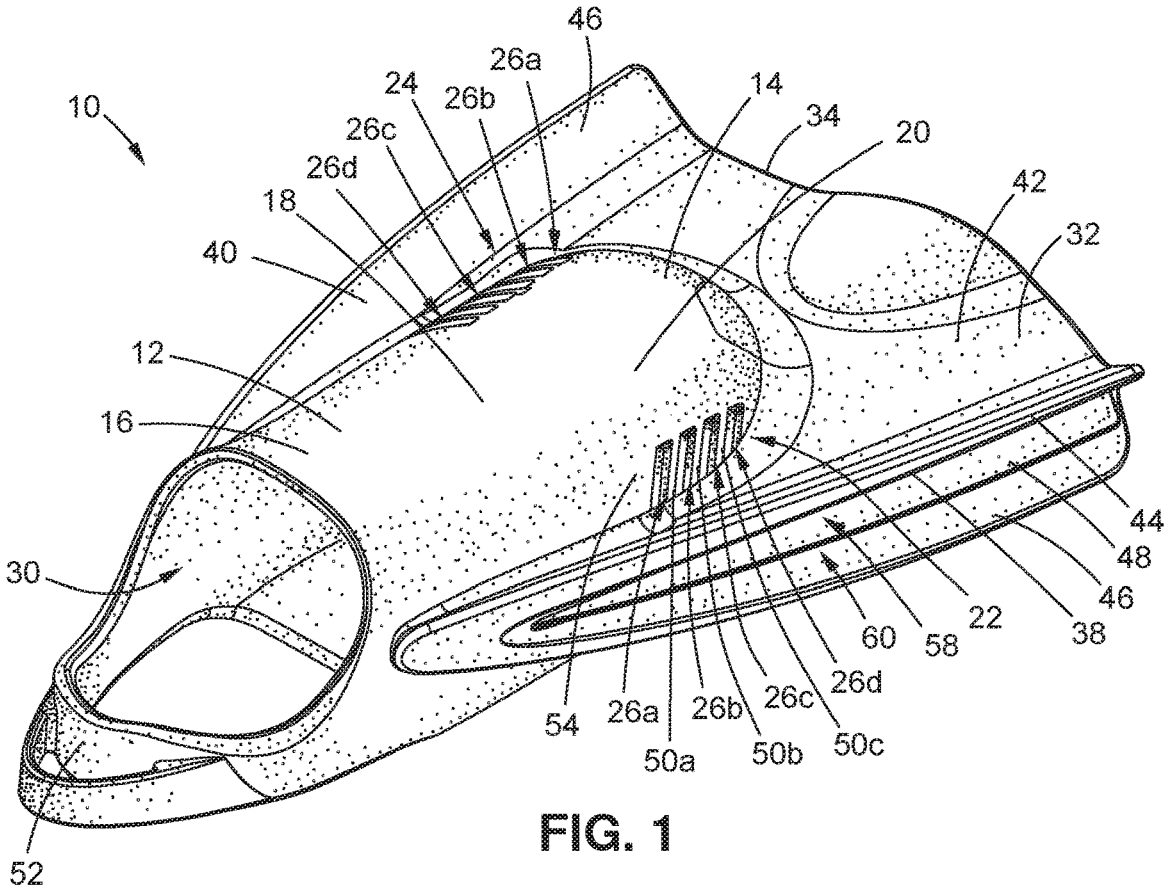
FIG. 1 is a perspective top view of a swim fin according to an embodiment of the invention.
Figure 2:
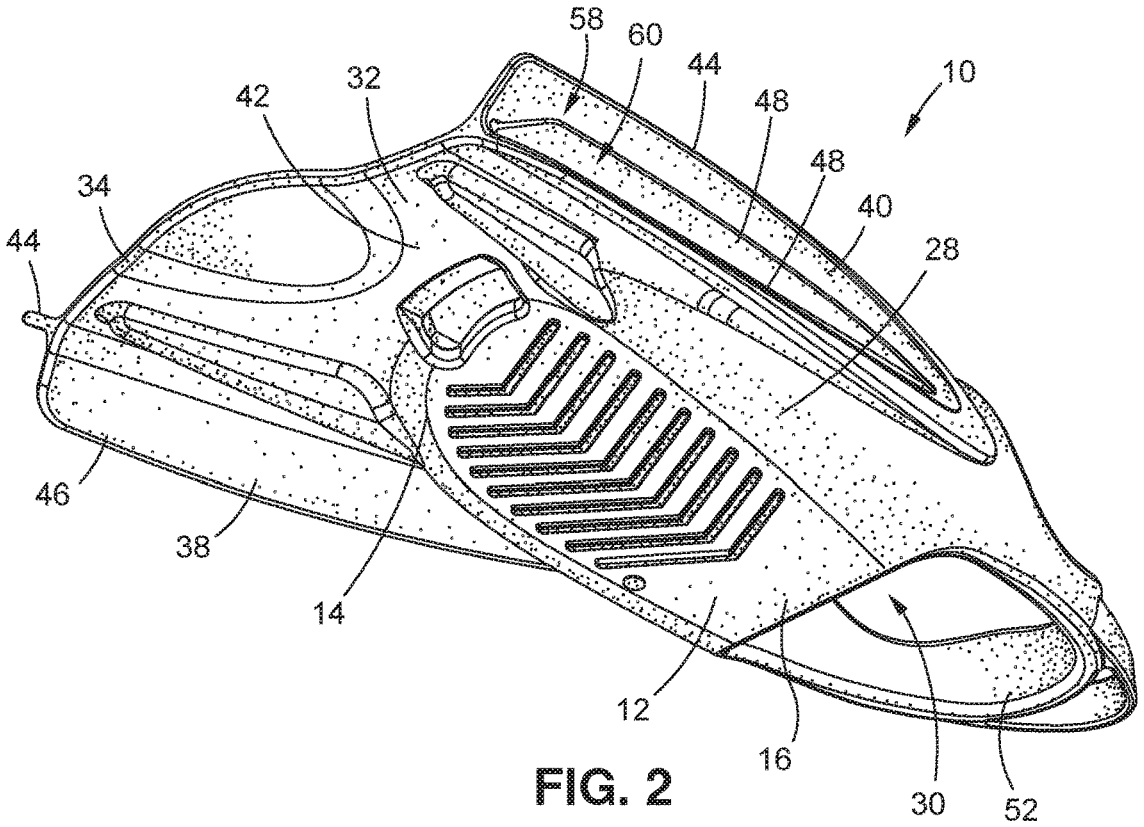
FIG. 2 is a perspective bottom of view of the swim fin of FIG. 1.
Figure 3:
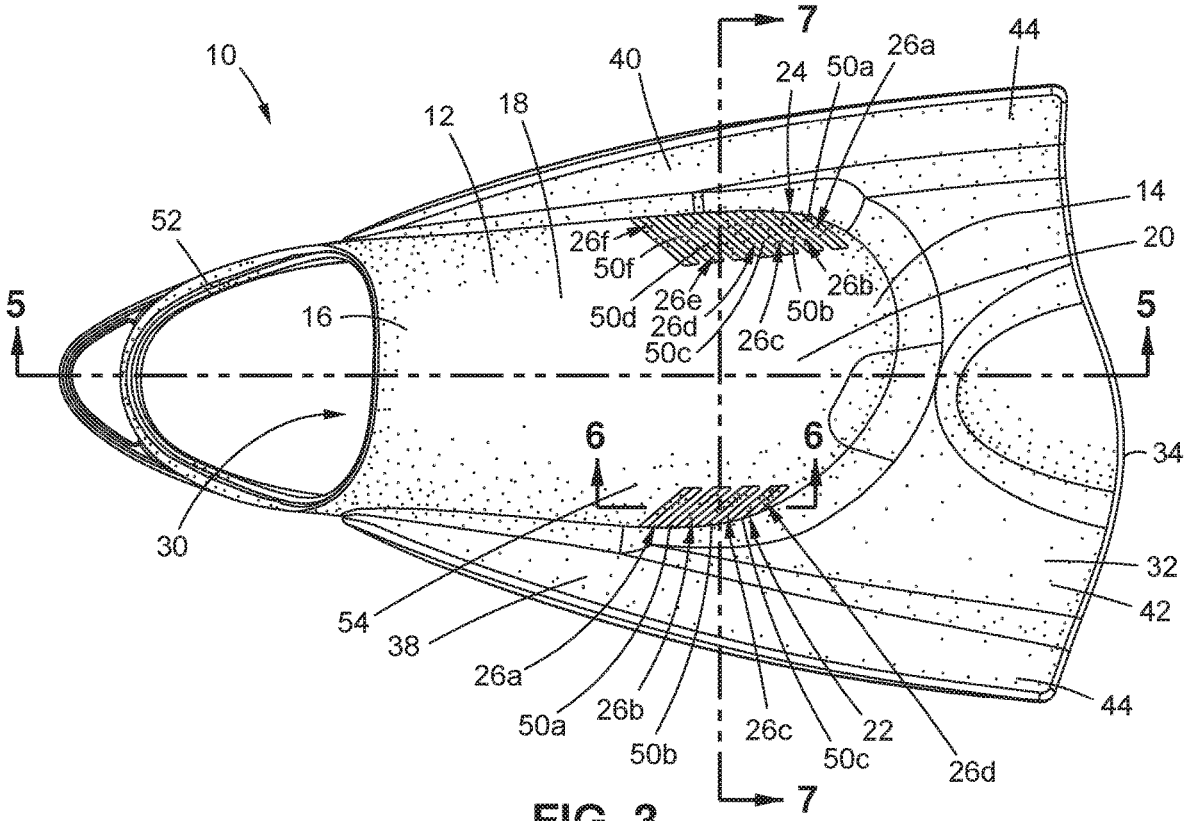
FIG. 3 is a top plan view of the swim fin of FIG. 1.
Figure 4:
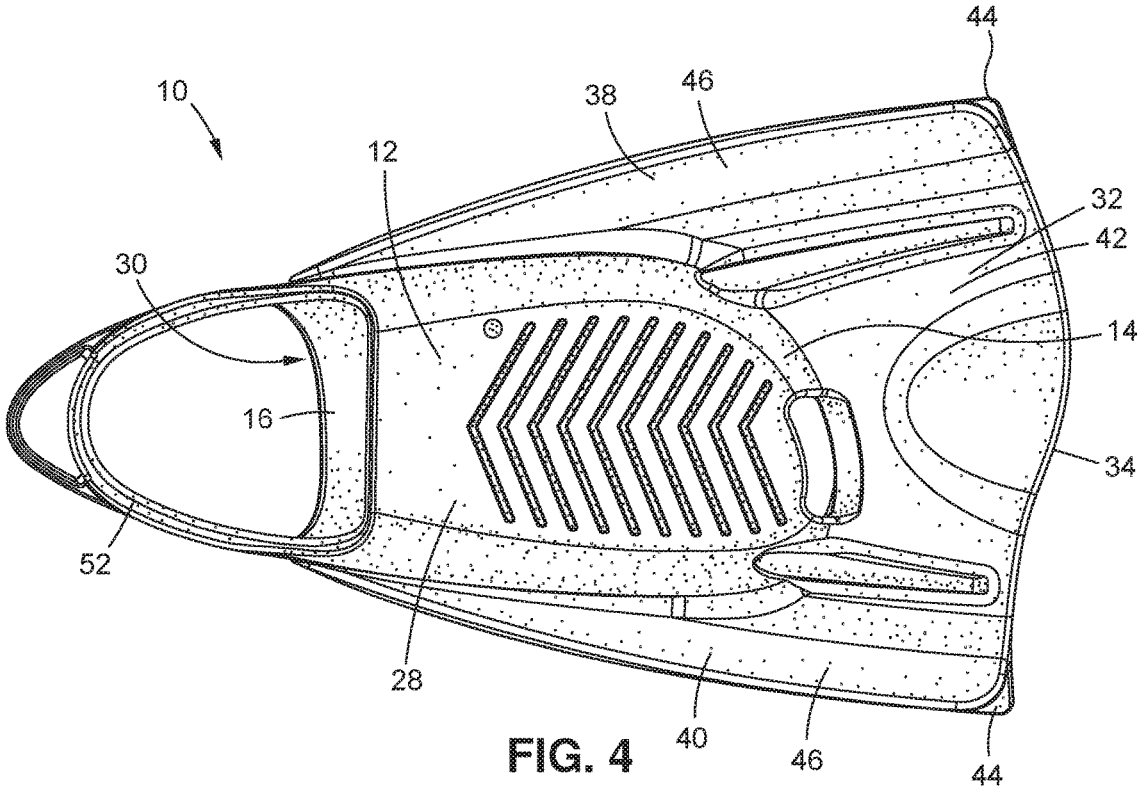
FIG. 4 is a bottom plan view of the swim fin of FIG. 1.
Figure 5:
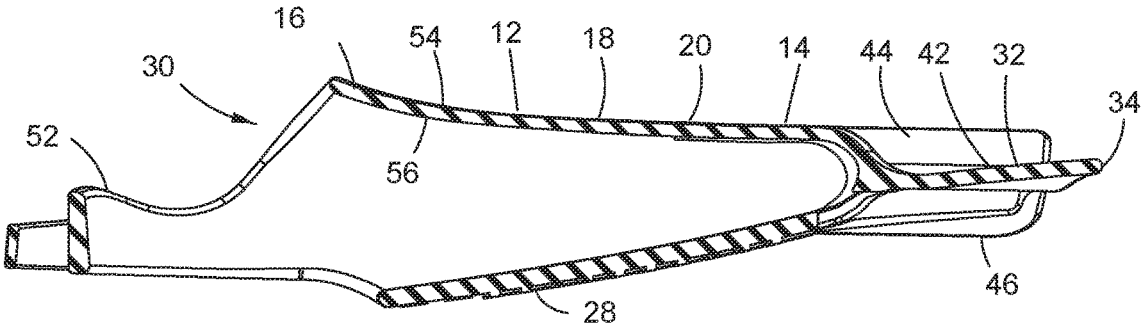
FIG. 5 is a cross-sectional view of the swim fin of FIG. 1 as viewed along axis 5-5 of FIG. 3.
Figure 6:
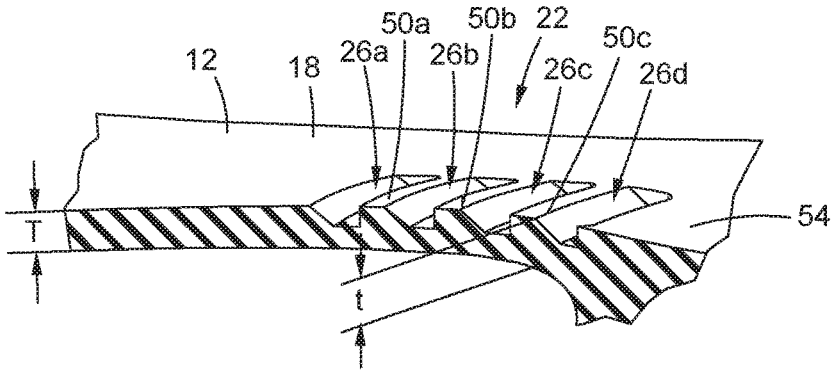
FIG. 6 is a cross-sectional view of a portion of a foot pocket at a first debossed region of the swim fin of FIG. 1 as viewed along axis 6-6 of FIG. 3.
Figure 7:
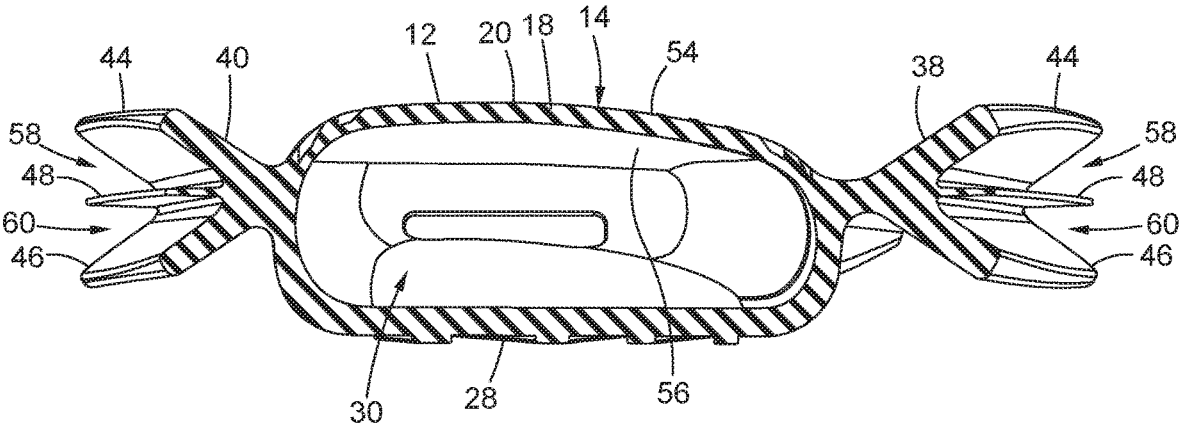
FIG. 7 is a cross-sectional view of the swim fin of FIG. 1 as viewed along axis 7-7 of FIG. 2.

Referring now to FIG. 1, there is depicted a perspective view of a swim fin 10 according to various aspects of the inventions described herein. FIGS. 1 and 2 respectively depict perspective top and bottom views of the swim fin 10. FIGS. 3 and 4 are respectively top and bottom plan views of the swim fin of FIG. 1. FIG. 5 is a cross-sectional view of the swim fin of FIG. 1 as viewed along axis 5-5 of FIG. 3. FIG. 6 is a cross-sectional view of a portion of a foot pocket at a first debossed region of the swim fin of FIG. 1 as viewed along axis 6-6 of FIG. 3. FIG. 7 is a cross-sectional view of the swim fin of FIG. 1 as viewed along axis 7-7 of FIG. 2.

In accordance with one embodiment, there is provided the swim fin 10 for wearing upon a foot of a user. The swim fin 10 includes a foot pocket 12 sized and configured to receive the foot of the user. The foot pocket 12 includes a front section 14 and a rear section 16. The foot pocket 12 further includes an upper portion 18 formed of an elastomeric material. The upper portion has a dorsal region 20, and first and second debossed regions 22, 24 with the dorsal region 20 disposed between the first and second debossed regions 22, 24. Each of the first and second debossed regions 22, 24 are laterally positionable adjacent the metatarsophalangeal joints of the foot of the user. Each of the first and second debossed regions 22, 24 have a plurality of grooves 26 formed therein (individually denoted 26*a-d* with respect to the first debossed region 22 and 26*a-g* with respect to the second debossed region 24). The foot pocket 12 further includes a sole 28. The foot pocket 12 further includes a foot pocket cavity 30 disposed between and defined by the upper portion 18 and the sole 28 for receiving the foot of the user. The swim fin 10 further includes a fin blade 32 extending from the front section 14 of the foot pocket 12. The fin blade 32 has a distal edge 34, a blade body 36 disposed between the distal edge 34 and the front section 14, and first and second triple-bladed rails 38, 40. The first and second triple-bladed rails 38, 40 are disposed longitudinally along the foot pocket 12 and the blade body 42 with the foot pocket 12 and the blade body 42 disposed between the first and second triple-bladed rails 38, 40. Each of the first and second triple-bladed rails 38, 40 have a top blade 44, a bottom blade 46, and a middle blade 48 disposed between the top and bottom blades 44, 46.

It is contemplated that the swim fin 10 having the first and second triple-bladed rails 38, 40 have a significantly enhanced water resistance, especially with the inclusion of the middle blade 48. Corresponding with such enhanced water resistance is an anticipated increased amount of pressure that would be experienced by the foot of the user. It is further contemplated that the configuration of the first and second debossed regions 22, 24 allow for an increased susceptibility of the upper portion 18 is be stretched or elastically deformed outwardly from the foot pocket cavity 30. As such the material of the upper portion 18 may "give" or deform outward during use and even upon the foot of the user being inserted into the foot pocket cavity 30 for relatively enhanced comfort and ease of putting on the user's foot. Further, this elastomeric deformation allows the pressures experienced across various portions of the foot of the user to be gradually spread so as to avoid substantial localized higher pressure variations or "hot spots" which lead to user discomfort. The widest portion of a foot of a user is contemplated to be adjacent the metatarsophalangeal joints of the foot of the user, and is it at such lateralmost portions of the foot where such localized higher pressures occur. It is at this locality where the first and second debossed regions 22, 24 are positioned.

It is contemplated that the various components of the swim fin 10 (as discussed above, and as discuss in the various embodiment below) may be constructed of materials and according to those manufacturing processes that are well known to one of ordinary skill in the art. In this regard, thermoplastic material of various properties may be used from the various components. Further, the particular embodiment depicted in the figures is shown by way of example, and other embodiments are contemplated for the various components of the swim fin 10 which may feature differing relative proportionality, shapes, thicknesses, contours, curvatures, angulations, surface features, flexibilities, strap configurations, and so forth. Also various features may be included or removed, including various vents, openings, gaps, rib or other which are well known to one of ordinary skill in the art. For example, the embodiment depicted includes a heel strap 52 that is integrally formed with the upper portion 18 and the sole 28, but such heel strap 52 may be of any number of alternative designs known to one of ordinary skill in the art.

According to various embodiments, each of the first and second debossed regions 22, 24 may have a stiffness less than a stiffness of the dorsal region 20. It is contemplated that such differences in stiffness may be facilitated by the relative difference is material absent or debossed from the first and second regions 22, 24. It is contemplated that the formation of the first and second debossed regions 22, 24 would not require any actual removal as the upper portion 18 may be formed through an injection molding process using thermoplastic material. The geometry of the first and second debossed regions 22, 24 would be a result of the associated mold shape.

Each of the first and second debossed regions 22, 24 may further have a plurality of ridges 50 (individually denoted 50*a-c* with respect to the first debossed region 22, and 50*a-g* with respect to the second debossed region 24) respectively disposed between the plurality of grooves 26. The upper portion 18 may have an outer surface 54 and an opposing inner surface 56 adjacent the foot pocket cavity 30. It is contemplated that the plurality of grooves 26 are formed in the outer surface 54 of the upper portion 18. In this regard, it is contemplated that flexure of the first and second debossed regions 22, 24 with the first and second debossed regions 22, 24 flexes outwardly with the plurality of grooves 26 "opening up" upon expansion or bulging at such localized area. The first and second debossed regions may each have a thickness at the ridges (denoted "t" in FIG. 6) the same as the thickness (denoted "T" in FIG. 6) of the dorsal region 20. However, it is contemplated that the relative thicknesses may be different.

The plurality of grooves 26*a-d* of the first debossed region 22 may generally extend toward the plurality of grooves 26*a-g* of the second debossed region 24 and away from the rear section 16, and the plurality of grooves 26*a-g* of the second debossed region 24 generally extend towards the plurality of grooves 26*a-d* of the first debossed region 22 and away from the rear section 16. This particular orientation allows for the first and second debossed regions 22, 24 to gradually flex or expand outward longitudinally along the foot pocket 12. The plurality of grooves 26 may be straight, such as depicted. Similarly, the plurality of ridges 50 may be straight, such as depicted. Other geometries, such as curvatures, are contemplated. In addition, the cross-sectional configurations of the plurality of grooves 26 and the plurality of ridges 50 are polygonal, these may be of differing cross-section configurations.

The first debossed region has an area different than an area of the second debossed region. In the embodiment depicted, the first debossed region 22 has an area less than an area of the second debossed region 24. It is contemplated that the relative sizing of pressure points or "hot spots" are different for each side of a user's foot. In this regard, the inner portion of a user's foot adjacent the metatarsophalangeal joint associated with hallux (i.e, "big toe") may be associated with a larger "hot spot." The swim fin 10 of the embodiment depicted would be particularly adapted for a user's right foot. Thus differences in the relative area of the first and second debossed regions 22, 24 may accommodate for differences in sides of a user's foot.

Each of the first and second triple-bladed rails 38, 40 may have a top channel 58 disposed between the top blade 44 and the middle blade 48, and a bottom channel 60 disposed between the middle blade 48 and the bottom blade 46. Each middle blade 48 may have a thickness less than a thickness of the adjacent top and bottom blades 44, 46. Each middle blade 48 may have a lateral length less than a lateral length of the adjacent top and bottom blades 44, 48. It is contemplated that the inclusion of middle blade 48 significantly increases the water resistance when the swim fin 10 is in use. It is further contemplated that the particular sizings, relative sizings, geometries, orientations, and angulations of the top, bottom, and middle blades 44, 46, 48 may differ from that which is depicted. The use of the three blades 44, 46, and 48 has been found to provide proper/increased water resistance during use to better strengthen the swimmer's leg muscles and improve the user's fast twitch muscles (i.e., the ankle up and down movement muscles).

The particulars shown herein are by way of example only for purposes of illustrative discussion, and are presented in the cause of providing what is believed to be the most useful and readily understood description of the principles and conceptual aspects of the various embodiments set forth in the present disclosure. In this regard, no attempt is made to show any more detail than is necessary for a fundamental understanding of the different features of the various embodiments, the description taken with the drawings making apparent to those skilled in the art how these may be implemented in practice.

What is claimed is:

1. A swim fin for wearing upon a foot of a user, the swim fin comprising:

a foot pocket sized and configured to receive the foot of the user, the foot pocket having:

a front section;

a rear section;

an upper portion formed of an elastomeric material, the upper portion having a dorsal region, and first and second debossed regions with the dorsal region disposed between the first and second debossed regions, each of the first and second debossed regions being laterally positionable adjacent the metatarsophalangeal joints of the foot of the user, each of the first and second debossed regions having a plurality of grooves formed therein;

a sole; and a foot pocket cavity disposed between and defined by the upper portion and the sole for receiving the foot of the user; and a fin blade extending from the front section of the foot pocket, the fin blade having:

a distal edge;

a blade body portion disposed between the distal edge and the front section; and first and second triple-bladed rails disposed longitudinally along the foot pocket and the blade body with the foot pocket and the blade body disposed between the first and second triple-bladed rails, each of the first and second triple-bladed rails having a top blade, a bottom blade, and a middle blade disposed between the top and bottom blades.

2. The swim fin of claim 1 wherein each of the first and second debossed regions has a stiffness less than a stiffness of the dorsal region.

3. The swim fin of claim 1 wherein each of the first and second debossed regions further has a plurality of ridges respectively disposed between the plurality of grooves.

4. The swim fin of claim 3 wherein the first and second debossed regions each has a thickness at the ridges the same as the thickness of the dorsal region.

5. The swim fin of claim 1 wherein the upper portion is formed of a thermoplastic material.

6. The swim fin of claim 1 wherein the plurality of grooves of the first debossed region generally extend towards the plurality of grooves of the second debossed region and away from the rear section, the plurality of grooves of the second debossed region generally extend towards the plurality of grooves of the first debossed region and away from the rear section.

7. The swim fin of claim 1 wherein the upper portion has an outer surface and an opposing inner surface adjacent the foot pocket cavity, the plurality of grooves are formed in the outer surface of the upper portion.

8. The swim fin of claim 1 wherein the first debossed region has an area different than an area of the second debossed region.

9. The swim fin of claim 1 wherein each of the first and second triple-bladed rails has a top channel disposed between the top blade and the middle blade, and a bottom channel disposed between the middle blade and the bottom blade.

10. The swim fin of claim 1 wherein each middle blade has a thickness less than a thickness of the adjacent top and bottom blades.

11. The swim fin of claim 1 wherein each middle blade has a lateral length less than a lateral length of the adjacent top and bottom blades.

* * * * *